US009759421B1

(12) United States Patent
Baschnagel

(10) Patent No.: US 9,759,421 B1
(45) Date of Patent: Sep. 12, 2017

(54) LIGHT BULB DEVICE WITH FUNCTIONAL FEATURES

(71) Applicant: Robert Baschnagel, Garden City, NY (US)

(72) Inventor: Robert Baschnagel, Garden City, NY (US)

( * ) Notice: Subject to any disclaimer, the term of this patent is extended or adjusted under 35 U.S.C. 154(b) by 19 days.

(21) Appl. No.: 14/870,391

(22) Filed: Sep. 30, 2015

Related U.S. Application Data

(63) Continuation-in-part of application No. 14/060,866, filed on Oct. 23, 2013, now Pat. No. 9,163,816.

(51) Int. Cl.

| | |
|---|---|
| ***F21V 33/00*** | (2006.01) |
| ***F21V 23/06*** | (2006.01) |
| ***F21V 23/04*** | (2006.01) |
| *F21V 23/00* | (2015.01) |

(52) U.S. Cl.
CPC ..... *F21V 33/0048* (2013.01); *F21V 23/04* (2013.01); *F21V 23/06* (2013.01)

(58) Field of Classification Search
CPC ..... F21V 33/0048; F21V 23/04; F21V 23/06
See application file for complete search history.

(56) References Cited

U.S. PATENT DOCUMENTS

| | | | | |
|---|---|---|---|---|
| 7,789,523 | B2 | 9/2010 | Arnold, III | |
| 8,013,545 | B2 | 9/2011 | Jonsson | |
| 8,382,315 | B2 | 2/2013 | Lee et al. | |
| 8,562,158 | B2 | 10/2013 | Chien | |
| 8,669,716 | B2 | 3/2014 | Recker et al. | |
| 8,893,968 | B2 | 11/2014 | Jonsson | |
| 8,899,797 | B2 | 12/2014 | Schaak | |
| 2007/0109782 | A1* | 5/2007 | Wolf | A01M 1/2083 362/253 |
| 2011/0287665 | A1* | 11/2011 | Chien | F21S 8/035 439/638 |
| 2014/0362559 | A1 | 12/2014 | Chien | |
| 2015/0009657 | A1 | 1/2015 | Bah | |

* cited by examiner

*Primary Examiner* — Anh Mai
*Assistant Examiner* — Nathaniel Lee
(74) *Attorney, Agent, or Firm* — Stan Collier, Esq.

(57) ABSTRACT

The light bulb device with functional features may include one or more features such as a dimmer function for the light source, an on/off function for the light source, a charger function for external devices using an USB port, an electrical outlet, a night light, etc. The light bulb thus converts the AC voltage in the conventional light socket to one or more usable voltages for electronic features therein or other electronic devices. One such feature is a dimmer function, another feature is one or more USB ports for charging or operating other devices such as video camera. Also, a Bluetooth connection may allow the device to act as a speaker or projector or a clock. A video monitoring feature may be included within the device that can be monitored via Bluetooth connection to a smart phone.

10 Claims, 7 Drawing Sheets

OR

MINI-PROJECTOR

MINI-VIDEO CAMERA

MOTION DETECTOR
SMOKE SENSOR
CO SENSOR
WIRELESS CONNECTOR
WIFI CONNECTOR

LIGHT BULB DEVICE WITH FUNCTIONAL FEATURES

CROSS REFERENCES TO RELATED APPLICATIONS

This is the continuation-in-part of regular utility application Ser. No. 14/060,866, filed Oct. 23, 2013, by the same inventor entitled "Energy Diverting Light Socket Plug" and incorporated by reference.

REFERENCE TO FEDERALLY SPONSORED RESEARCH OR DEVELOPMENT

NA

REFERENCE TO JOINT RESEARCH AGREEMENTS

NA

REFERENCE TO SEQUENCE LISTING

NA

BACKGROUND OF THE INVENTION

Field of the Invention

The present invention relates to consumer electronic devices, and, more particularly, to electronic devices used in a home environment, and, in greater particularity, relates to disposable light bulbs.

Description of the Prior Art

The electrical outlet provided by a light socket may be used for devices for controlling the light and other functions that would be desirable in a home.

Electrical devices for use with light sources such as incandescent lights, fluorescent lights, LEDs placed in one socket may include a means mounted in a wall switch to turn on/off and/or dim the light source that saves energy when operating a light source and also allows the user to adjust the intensity of the light source to a desired level.

Electrical sockets can come in different sizes and shapes and are used in many different locations such as homes, offices or public places. An electrical socket including the device for hold the electrical socket can be mounted on a permanent surface such as a ceiling or on a moveable structure such as a table lamp or ceiling fan.

Electric lighting is well understood and has been used for years. Also the ability to dim a light bulb is also well understood. Usually in order to dim a light bulb, it is achieved by adjusting a dimmer switch that is located at the point where the light is either turned on or off. If a light bulb is screwed into a socket, the user would then rely upon the wall switch to have an additional feature of being able to dim the light. If such a switch exists, then the user can dim or lessen the brightness of the light-emitting bulb accordingly. Another device for controlling the light is a device plugged into the wall outlet with the plug for the light therein. This device turns the metal frame into a touch device for controlling the light. These features allow the user to adjust the brightness of the lighting within a room in accordance with a user's needs when using the lighting element itself. The need for dimming a light are numerous. Primarily a person will at some point find the need to dim the lighting within a particular room in their home environment. This can be done during dinner time to create a certain mood or while watching television in order to enable better viewing of the television itself. Also, nowadays with desk top computers, the lighting within a room maybe too bright to enjoy the use of the computer and there is thus a need to dim such lighting.

Typical light switches do not include the dimming feature due to the added cost of that type of switch. This may result in a user changing the wall switch to add a switch with the dimming feature. This work may be dangerous and even deadly and would require an electrician raising the cost even higher.

Another option to is change the light source such as an incandescent light to a different wattage. Unfortunately the consumer can not then adjust the light level without changing the source again. This may require the consumer to use a ladder to reach high sources and thus presents a danger of falling.

U.S. Patent Application Pub. 2014/0362559 discloses a device for mounting to a wall electrical outlet having a light therein as well as other features to compliment the modern home with smart devices therein. Other devices are shown that are mounted in light sockets or other outlets or are stand-alone to provide features desirable in a modern home: U.S. Pat. Nos. 7,789,523; 8,013,545; 8,382,315; 8,422,889; 8,562,158; 8,669,716; 8,893,968; and 8,899,797. All of these references are incorporate by reference as to their teachings. Although adapters for light sockets show USB therein, the USB are mounted in the main housing and would be difficult to find in the dark because they are not outstanding.

Accordingly, there is a need for a device that provides convenience to the consumer not only a dimming feature, but other features that are necessitated by today's modern home having numerous personal electronic devices therein such a cell phones, smart phones, tablets, etc.

SUMMARY OF THE INVENTION

The present invention is a light bulb device having a main housing with one or more features therein.

The present invention is a light bulb device including one or more features such as a dimmer function for the light source, an on/off function for the light source, a charger function for external devices through one or more USB ports, an electrical outlet, a night light, etc. Two or more features can be combined in one light bulb device. The light bulb device itself thus will convert the AC voltage in the conventional light socket to one or more usable voltages for electronic features therein or other electronic devices connected thereto as will be disclosed herein. Also, a Bluetooth connection may allow the device to act as a speaker or projector or a clock. A video monitoring feature may be included within the device that can be monitored via Bluetooth connection to a smart phone.

One object of the present invention is to provide a disposable light bulb device having one or more additional features therein.

It is another object of the present invention to provide a light bulb device with multiple features therein, but is inexpensive and may be thrown away.

It is a further object of the present invention to provide a light bulb device having a dimmer function with an on/off switch.

It is still a further object of the present invention to provide a light bulb device having one or more USB ports for allowing the charging of an electronic device.

It is still another further object of the present invention to provide a light bulb device having a nightlight therein.

These and other objects, features, and advantages of the present invention will become more readily apparent from the attached drawings and the detailed description of the preferred embodiments, which follow.

BRIEF DESCRIPTION OF THE DRAWINGS

Like reference numerals refer to like parts throughout the several views of the drawings.

DETAILED DESCRIPTION OF THE PREFERRED EMBODIMENTS

With the proliferation of mobile electronic devices in the modern home, appropriate devices are required to provide power thereto or interact therewith. The present invention is a light bulb device with one or more features therein including one or more features such as a dimmer function for the light source, an on/off function for the light source, a charger function for external devices, an electrical outlet, a nightlight, etc. The light bulb device thus will convert the AC voltage in the conventional light socket to one or more usable voltages for electronic features therein or other electronic devices connected thereto as will be disclosed herein.

Figure 1:
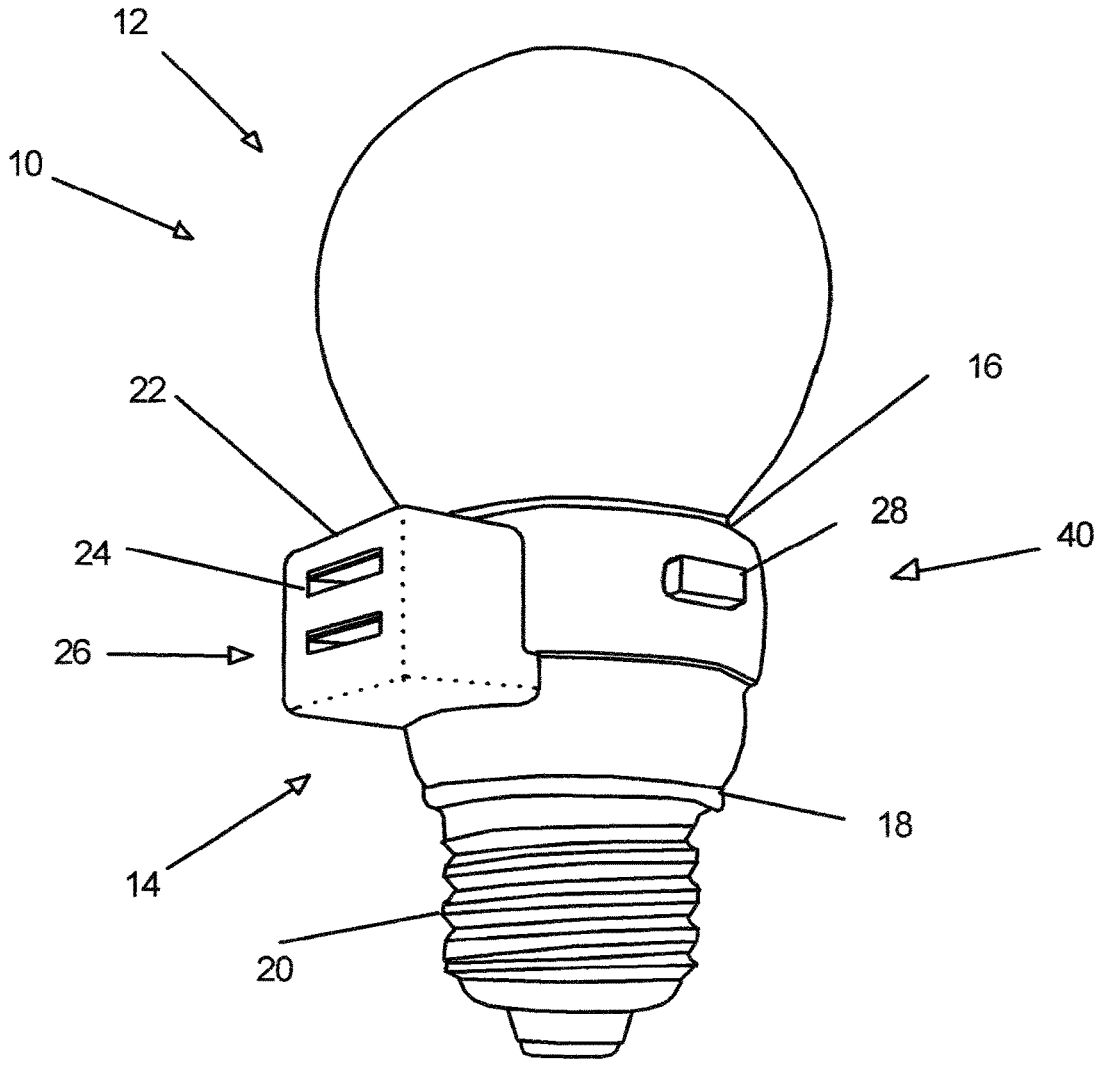
FIG. 1 is a perspective view of a light bulb device of the present invention having a main housing with a side housing for at least one USB port and an on/off switch on the main housing.

Referring to FIG. 1, a preferred embodiment of a light bulb device 10 is shown. The light bulb device 10 has a light source 12 that may be an incandescent light, a fluorescent light, or a LED light, but is considered generic and the shape shown in FIG. 1 or other figures is not relevant to the present invention or limiting. The light source 12 is fixedly attached to a main housing 14 at a top 16 and can not be removed from the main housing 14. If the light source 12 does not work, the light bulb device 10 is disposed of in the appropriate manner. Modern devices such as LED lights have extended life into the years as compared to incandescent lights that may last months. The use of graphene in light sources promises to extend the life even longer than traditional LEDs. Thus the present invention must balance the number and types of additional features against the cost since the light bulb device is disposable. An on/off switch 28 is shown in FIG. 1 so that even when the light source is turned off, the USB or electrical outlet have power thereto.

At a bottom 18 in FIG. 1, a male threaded base 20 is fixedly mounted to the main housing 14. The male threaded base 20 is capable of removable attachment to a light socket, not shown, but considered conventional. A side housing 22 is fixedly attached to the main housing 14 and protrudes from the main housing 14. The side housing 22 may be box shaped and has an outer wall 24 that is flat and has at least one or more USB outlets 26 therein. Having a side housing 22 of a protruding shape is superior in design as compared to placing the USB directly in the tubular shaped main housing 14 in that it can then be found in the dark or darken room. Minimally, the USB outlet 26 may provide a source of power to charge an attached device via USB cable, not shown. The USB port 26 may have a conventional design for accepting USB plugs such as Type A 44, Type B, Type Mini A, Type Mini B, Type Micro B, or Type Mini P.

Figure 3:
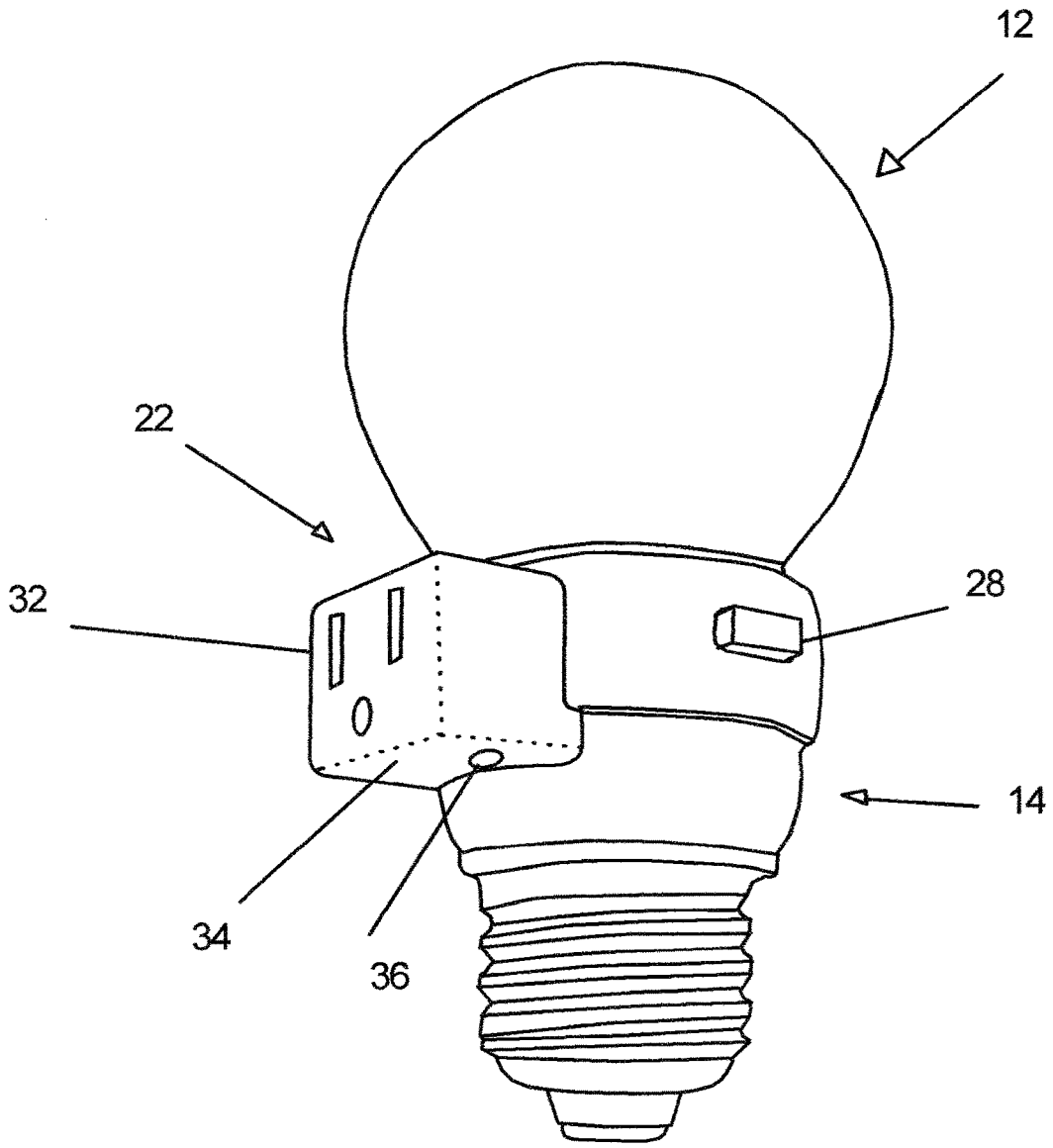
FIG. 3 is a perspective view of another embodiment of the light bulb device of the present invention further including an electrical outlet and a nightlight.

Supporting electrical means for providing predetermined electrical energy to the one or more USB outlets, the light source and other features are schematically shown in FIG. 4 when connected to the light socket. Also shown is the on/off switch 28 in FIGS. 1 and 3, for a light control 40 attached to the main housing 14 for controlling the light source 12.

Figure 2A:
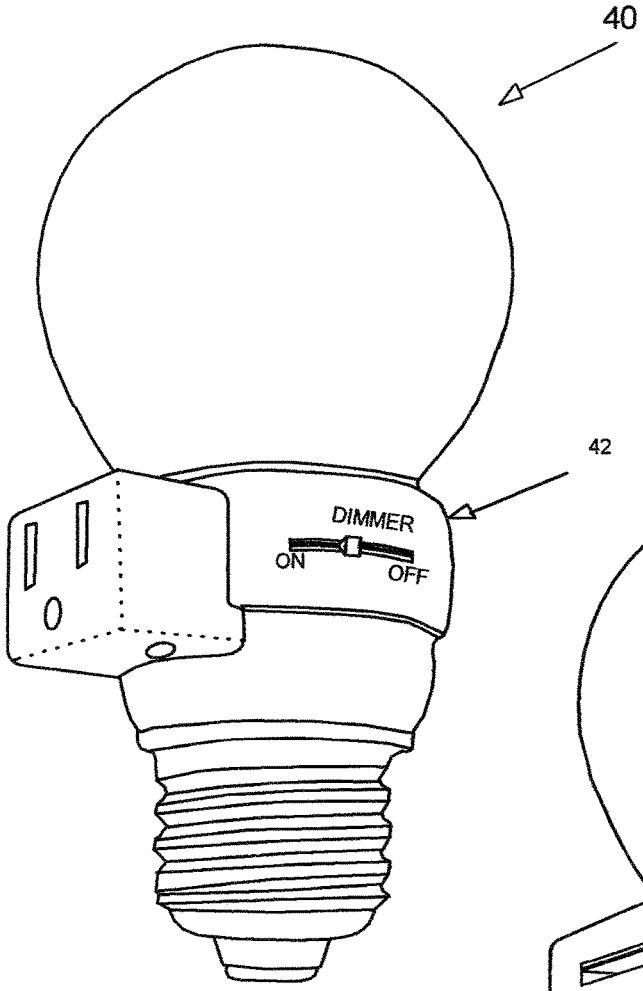
FIGS. 2A and 2B show perspective views of a light bulb devices of the present invention having a dimmer function combined with the USB function or and electrical outlet function.
Figure 2B:
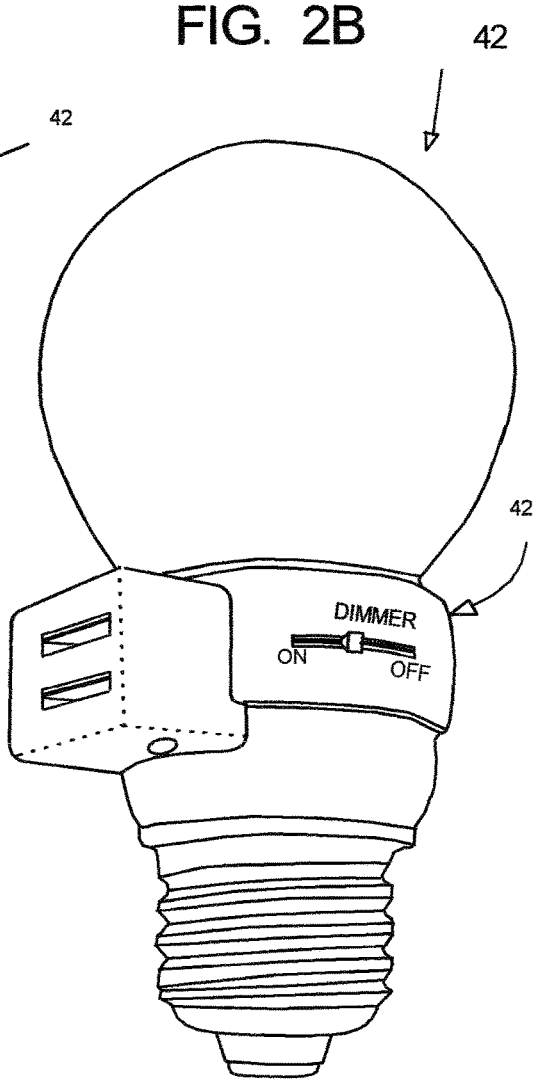

FIG. 2A is another embodiment of the light bulb device 10 except the on/off switch 28 of FIG. 1 is replaced with a dimmer/on/off switch 42 in the light bulb device 40. The dimmer switch can slide sideways and provide a dimming feature. The dimmer switch 42 moves from an off position at the right side to fully on position and along the way from zero to 100% power to the light source 12. FIG. 2B is a light bulb device 42 having an electrical outlet and a dimmer switch.

Figure 4A:
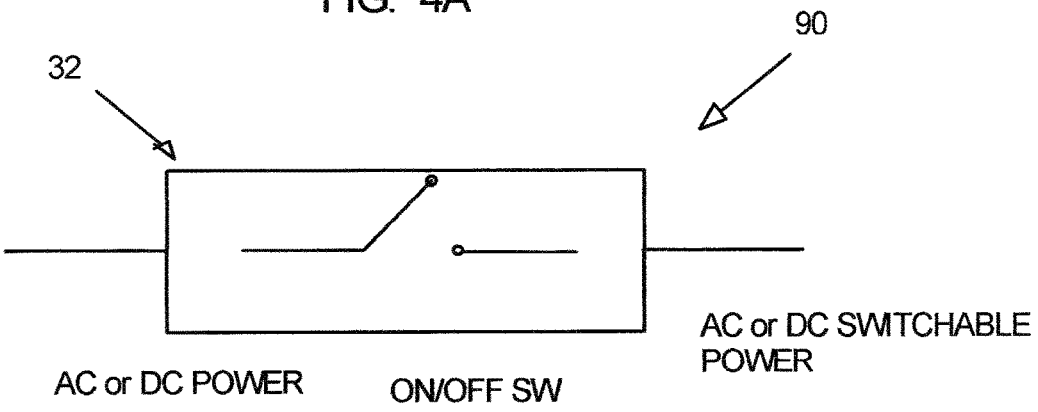
FIGS. 4A, 4B, 4C, 4D, 4E, 4F and 4G illustrate various conventional electrical block schematics for the various possible embodiments shown herein.
Figure 4B:
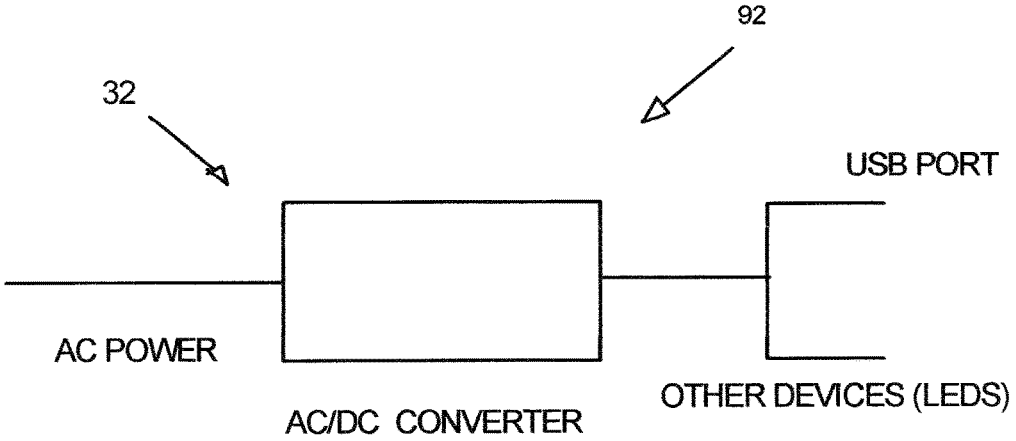
Figure 4C:
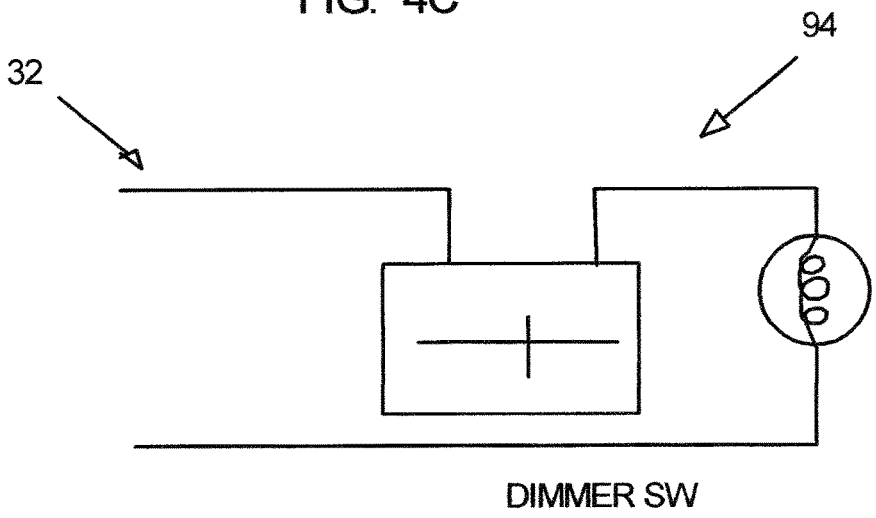
Figure 4C:
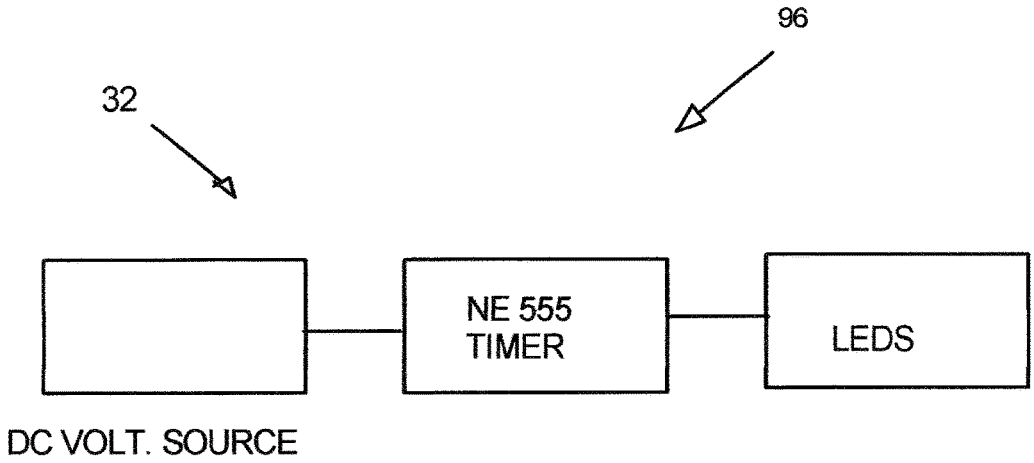

Referring to FIGS. 4A and 4B, the light bulb device 10 may also include a 120 VAC outlet 32 or other working voltages as in foreign countries in the side housing 22 instead of the USB outlet or have both mountable therein or having additional side housings. Another feature shown on a bottom 34 of the side housing 22 is a nightlight 36 seen in FIG. 3. The on/off switch 28 may then operate to turn the nightlight 36 on or off instead of the light source 12. If the nightlight can be turned on by moving the dimmer switch to the on position on the left, the light source 12 would be turned off, but an additional switch may be included just for the nightlight feature.

Electrical means 32, FIGS. 4A to 4G, are located in the main housing 12 for providing predetermined electrical energy and features to the one or more USB outlets 26, the light control 30 and the light source 12 or other features as shown herein. The device 10 can be composed of plastic, metal, or any other material that is appropriate. All of the electrical wires and devices must be enclosed to prevent electrical shock to the user.

Figure 4D:
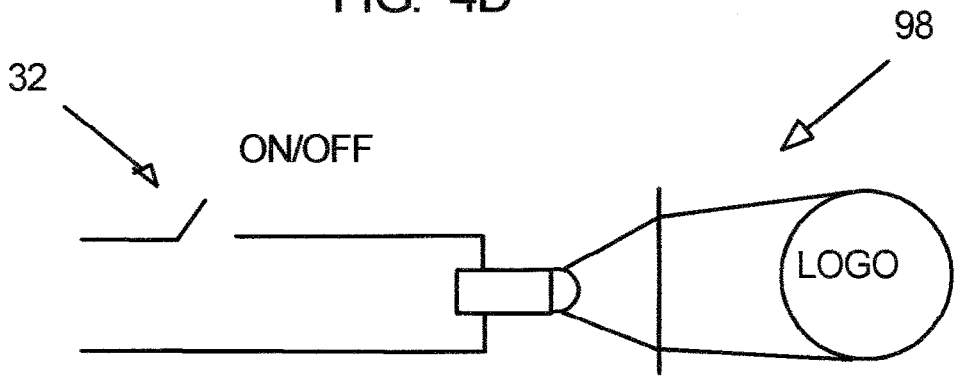
Figure 4E:
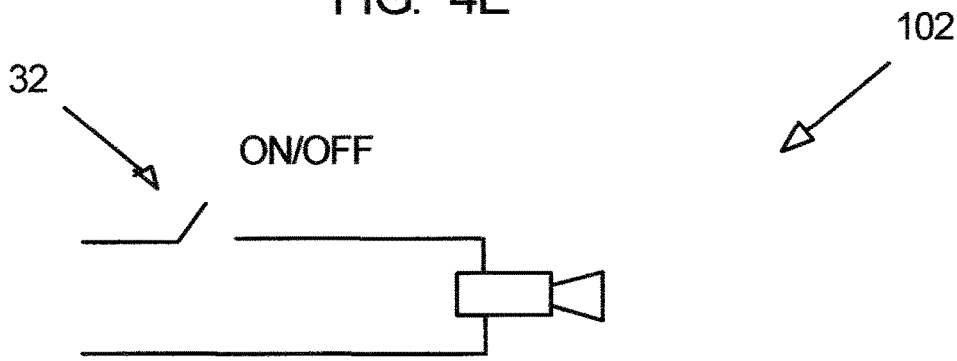
Figure 4F:
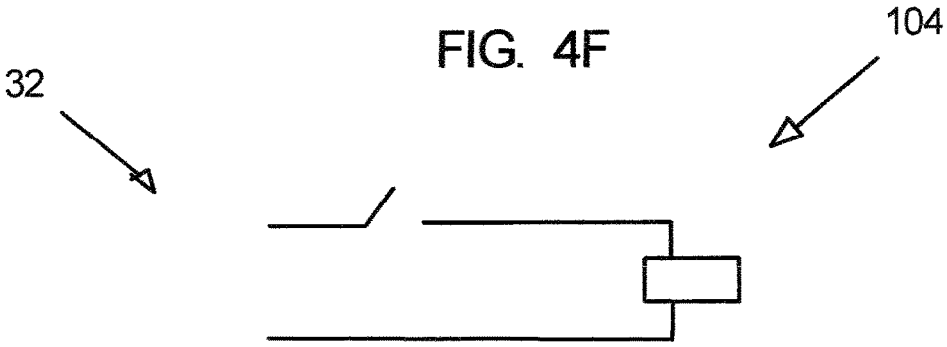
Figure 4G:
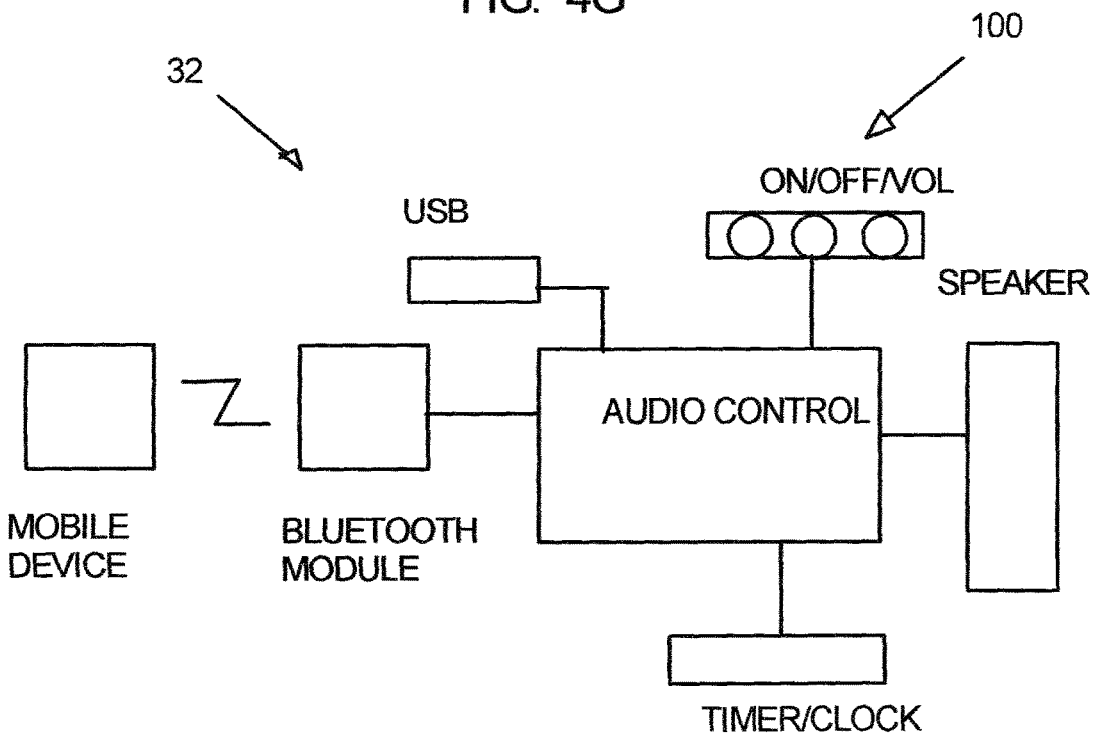

Referring to FIG. 4A, the electrical means 32 are partially illustrated therein. FIG. 4A illustrates a basic on/off switch 90 that may be used to provide switchable AC or DC power to the electrical devices therein. This may be operated by a pull cord or chain, not shown. Any of the features shown herein may be operated via mobile device having an appropriate App therein via a Bluetooth connection. FIG. 5B illustrates an AC/DC converter 92 that provides for a variety of DC voltages to the device 10 as needed including devices connected to the USB ports. FIG. 5C illustrates a slider dimmer switch 94 that operates an incandescent lamp. Also shown is a dimmer switch 96 that is used to operate LEDs that uses a pulse wave timer NE 555 chip. Many different types of features can be available such as shown in FIG. 4. FIG. 4D is a projector 98 for placing an image on the inside of a lamp shade, not shown, or even a wall. FIG. 4E is a mini-video camera 102. This can be operated as above to monitor house activities therein such as children, guests, intruders, etc., and even call for emergency assistance as necessary. FIG. 4F is a generic block diagram of the many possible features that can be incorporated into the light bulb device 10. FIG. 4G illustrates a music player 100.

The light bulb device 10 is preferably used on a desk or table lamp, not shown, but considered conventional. Also, the light bulb device may incorporate additional features other than the ones shown above such as a CO detector, a smoke detector/alarm, a pest repellant, a motion detector, a sound recorder, a themed light setting such as blinking, color changing, etc.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A light bulb device with one or more functional features, said light bulb device comprising:

a light source;

a main housing, said light source fixedly mounted in a top of said main housing, and a side housing mounted to said main housing;

a male threaded base, said male threaded base fixedly mounted to a bottom of said main housing, said male threaded base being capable of removable attachment to a light socket;

one or more USB outlets fixedly mounted in said light bulb device in said side housing; and electrical means for providing predetermined electrical energy to said one or more USB outlets and said light source when connected to the light socket.

2. The light bulb device as defined in claim 1, wherein said light source is an incandescent source, a fluorescent source or a LED source.

3. The light bulb device as defined in claim 2, further including a light control being an on/off switch or a dimmer switch or a combination dimmer switch and on/off switch function, mounted in said main housing.

4. The light bulb device as defined in claim 2, further including an electrical outlet providing a conventional AC voltage mounted in said side housing.

5. The light bulb device with one or more functional features, said light bulb device comprising:

a light source;

a main housing, said light source fixedly mounted in a top of said main housing, and a side housing mounted to said main housing;

a male threaded base, said male threaded base fixedly mounted to a bottom of said main housing, said male threaded base being capable of removable attachment to a light socket;

one or more USB outlets fixedly mounted in said light bulb device in said side housing; and a light control, said light control mounted in said light bulb device; and electrical means for providing predetermined electrical energy to said one or more USB outlets and said light source when connected to the light socket.

6. The light bulb device as defined in claim 5, wherein said light source is an incandescent source, a fluorescent source or a LED source.

7. The light bulb device as defined in claim 6, wherein said light control comprises an on/off switch or a dimmer switch or a combination dimmer switch and on/off switch function, mounted in said main housing.

8. The light bulb device as defined in claim 6, further including an electrical outlet providing a conventional AC voltage mounted in said side housing.

9. The light bulb device with one or more functional features, said light bulb device comprising:

a light source;

a main housing, said light source fixedly mounted in a top of said main housing, and a side housing mounted to said main housing;

a male threaded base, said male threaded base fixedly mounted to a bottom of said main housing, said male threaded base being capable of removable attachment to a light socket;

one or more USB outlets fixedly mounted in said light bulb device in said side housing;

a light control, said light control mounted in said light bulb device;

an electrical outlet providing a conventional AC voltage mounted to said side housing; and electrical means for providing predetermined electrical energy to said one or more USB outlets and said light source when connected to the light socket.

10. The light bulb device as defined in claim 9, wherein said light source is an incandescent source, a fluorescent source or a LED source.

* * * * *